US007276467B2

(12) United States Patent
Nuckols et al.

(10) Patent No.: US 7,276,467 B2
(45) Date of Patent: Oct. 2, 2007

(54) INSULATING MEDIUM

(75) Inventors: Marshall L. Nuckols, Annapolis, MD (US); Jerry A. Henkener, Canyon Lake, TX (US)

(73) Assignee: Southwest Research Institute, San Antonio, TX (US)

( * ) Notice: Subject to any disclaimer, the term of this patent is extended or adjusted under 35 U.S.C. 154(b) by 1357 days.

(21) Appl. No.: 09/949,287

(22) Filed: Sep. 7, 2001

(65) Prior Publication Data

US 2007/0078065 A1 Apr. 5, 2007

Related U.S. Application Data

(60) Provisional application No. 60/230,679, filed on Sep. 7, 2000.

(51) Int. Cl.
*C10M 105/50* (2006.01)
*C10M 125/26* (2006.01)

(52) U.S. Cl. ..... 508/590; 508/138; 508/219

(58) Field of Classification Search ..... 508/590
See application file for complete search history.

(56) References Cited

U.S. PATENT DOCUMENTS 3,744,053 A 7/1973 Parker et al. ..... 2/2.1
4,428,851 A * 1/1984 Hisamoto et al. ..... 508/579
4,528,109 A * 7/1985 Fifolt et al. ..... 252/78.1
4,900,463 A * 2/1990 Thomas et al. ..... 252/68
5,013,472 A * 5/1991 Marraccini et al. ..... 252/78.1
5,145,592 A * 9/1992 Caporiccio ..... 508/582
5,209,861 A * 5/1993 Gschwender et al. ..... 508/409
5,960,469 A 10/1999 Nuckols et al. ..... 2/2.1
6,120,530 A * 9/2000 Nuckols et al. ..... 607/108
6,268,321 B1 * 7/2001 Sprague ..... 508/590
6,291,803 B1 * 9/2001 Fourrey ..... 219/497
6,484,514 B1 * 11/2002 Joseph et al. ..... 62/4
6,644,383 B2 * 11/2003 Joseph et al. ..... 165/46

OTHER PUBLICATIONS

'Olsen, "RF Energy for Warming Divers' Hands and Feet," *Emerging Electromagnetic Medicine*, 135-143, 1990.
Weinberg and Thalmann, "Effects of Hand and Foot Heating on Diver Thermal Balance," Naval Medical Research Institute Report No. NMRI-90-52, Bethesda, MD, 1989.

* cited by examiner

*Primary Examiner*—Ellen McAvoy
(74) *Attorney, Agent, or Firm*—Fulbright & Jaworski LLP

(57) ABSTRACT

The disclosed invention provides a composition that possesses insulation values approaching that of uncompressed foam neoprene. The liquid composition is incompressible and may be formulated to be neutrally buoyant in water. The composition is suitable for a use in a number of applications where insulation is required, including divers' suits and underwater cabins, such as chambers, submersible hulls, and waterproof housings.

30 Claims, 6 Drawing Sheets

INSULATING MEDIUM

The present application claims the priority of U.S. Provisional Application Ser. No. 60/230,679 filed Sep. 7, 2000, the entire disclosure of which is incorporated herein by reference.

The government owns rights in the present invention pursuant to Government Contract No. N61331-99-C-0027 for Naval Experimental Diving Unit.

BACKGROUND OF THE INVENTION

I. Field of the Invention

The present invention relates generally to compositions providing superior thermal insulation. More particularly, the invention relates to composition comprising liquids with low thermal conductivity, such as a halocarbon oil, emulsifying agents, and microcapsules. The invention also relates to the use of these compositions in various insulating garments.

II. Description of the Related Art

Thermal protection for divers and underwater cabins (e.g., chambers, submersible hulls, waterproof housings, etc.) is an area that has garnered considerable research effort. Much of this research has focused on passive methods for thermal insulation. Passive methods for thermally protecting a submerged cabin or diver from extreme cold water exposures share a common advantage over their active heating alternatives, namely there is no requirement for energy storage or energy distribution. This advantage tends to make passive thermal protection systems less complex, and usually less expensive. Unfortunately, in extremely cold waters, passive systems have customarily required the use of thick, layered insulating materials. For instance, such passive systems often require that divers wear either foam neoprene or fibrous batts beneath waterproof jackets to reduce the loss of heat to the surrounding cold water.

These conventional insulating materials suffer from several disadvantages. For instance, the materials tend to be excessively bulky, thereby inhibiting mobility when used by divers. Such materials are also normally inherently buoyant. This is undesirable because it necessitates the use of lead weights or other ballasting materials to make the insulating medium neutrally buoyant. Furthermore, conventional materials typically used in passive insulating systems usually are highly variable in insulating effect due to compression of the materials that is caused by the increased hydrostatic pressure as depth increases. Finally, it is often difficult to keep conventional materials waterproof The failure of the materials to maintain an impermeability to water could fatally reduce the degree of thermal protection afforded by the materials.

Syntactic foams, rigid polymers loaded with hollow glass microballoons, have frequently been utilized as an insulating medium for deep underwater applications where mobility is not a concern due to their minimal compressibility. However, similar to foam neoprene and insulating batt materials, syntactic foams are buoyant and have only moderate insulating capability.

The shortcomings of the insulating materials of the prior art may be readily seen by examining, for example, traditional diver gloves. A diver's ability to perform meaningful work is greatly diminished in long-duration missions if his hands are cold when the mission objective has been reached. Unfortunately, in extremely cold water diving, conventional gloves use thick, foam neoprene or layered insulating materials worn beneath waterproof glove shells to reduce the loss of body heat to the surrounding cold water. These gloves tend to be a) excessively bulky —inhibiting finger sensitivity and manual dexterity; b) inherently buoyant; c) highly variable in insulating effect due to material squeeze as hydrostatic pressures increase; and d) difficult to keep waterproof—an uncertainty that could fatally reduce the diver's thermal protection during long-duration missions. This dilemma between thermal protection and manual dexterity has often forced the diver to make decisions about how to maximize his performance using inadequate equipment. Accordingly, a need still therefore exists for an insulating material that possesses minimal bulk, low thermal conductivity, and neutral buoyancy.

SUMMARY OF THE INVENTION

In one aspect, the invention provides a composition comprising a liquid with a thermal conductivity of less than about 0.04 Btu/ft-hr-° F., an emulsifying agent and a plurality of microcapsules. In certain embodiments of the invention, the liquid is a halocarbon oil. The halocarbon oil may comprise additives or other types of ingredients, such as chlorotrifluoroethylene or polymers thereof. Exemplary halocarbon oils for use with the invention have a viscosity of from about 0.8 centistokes to about 56 centistokes when measured at 100° F. Examples of halocarbons in this class include halocarbon 0.8, halocarbon 6.3 or halocarbon 27S, or mixtures thereof.

In particular embodiments of the invention, the microcapsules may comprise about 5% to about 60% by volume of the composition, or alternatively, may comprise about 40% to 50% by volume of the composition. The composition may have a thermal conductivity of less than about 0.06 Btu/ft-hour-° F., including less than about 0.04 Btu/ft-hour-° F., and may further have a thermal conductivity of between about 0.02 and about 0.06 Btu/ft-hour-° F. In the composition, the emulsifying agent may comprise about 3% to about 8% by weight of the composition, including about 5% to about 8% by weight of the composition. Potentially any suitable emulsifying agent could be used, including xanthan gum, ethyl cellulose, clay, collodial clay and microcapsules. The microcapsules may be comprised of glass, may be hollow and may comprise a heat-absorbing material.

The composition may further comprise water. In one embodiment of the invention, the composition comprises about equal parts of the water and the oil, wherein the emulsifying agent comprises a xanthan gum, and wherein the microcapsules comprise about 36% by volume of the composition. In another embodiment of the invention, the emulsifying agent comprises about 6%-8% by weight of a collodial clay, and wherein the microcapsules comprise about 28% by volume of the composition. The composition may be further defined as having a specific gravity of about 1.0.

In another aspect, the invention provides a method for preparing a composition suitable for use as an insulator, the method comprising mixing a liquid with a thermal conductivity of less than about 0.04 Btu/ft-hr-° F., a plurality of microcapsules, and an emulsifying agent, wherein the emulsifying agent is present in sufficient amount to suspend the microcapsules in the composition. The liquid may be a halocarbon oil and may further include additional ingredients, such as chlorotrifluoroethylene or polymers thereof. In preferred embodiments of the invention, the halocarbon oil has a viscosity of from about 0.8 centistokes to about 56 centistokes when measured at 100° F. Exemplary halocarbon oils include halocarbon 0.8, halocarbon 6.3, and halocarbon 27S, or mixtures thereof. Exemplary emulsifying agents include xanthan gum, ethyl cellulose, a clay, or mixtures thereof. The clay may be a collodial clay.

In yet another aspect, the invention provides an insulating garment comprising: a first liquid impermeable layer, a second liquid impermeable sheet overlaying and bonded to the first layer, the first and second layers forming a reservoir, a liquid composition comprising a halocarbon oil, an emulsifying agent, and a plurality of microcapsules, wherein the liquid composition is disposed between the first liquid impermeable layer and the second liquid impermeable layer. The halocarbon oil may further include additional ingredients, such as chlorotrifluoroethylene or polymers thereof. In preferred embodiments of the invention, the halocarbon oil has a viscosity of from about 0.8 centistokes to about 56 centistokes when measured at 100°. Exemplary emulsifying agents include xanthan gum, ethyl cellulose, a clay, or mixtures thereof The clay may be a collodial clay. The microcapsules may be comprised of glass, may be hollow and may comprise a heat-absorbing material. In the apparatus, the first liquid impermeable layer is configured to conform substantially to a body portion over which it is placed, such as a human hand. The apparatus may also further comprise a valve coupled to the first liquid impermeable layer or second liquid impermeable layer, whereby the liquid composition may be inserted or removed from the reservoir through the valve.

In still yet another aspect, the invention provides a glove for providing insulation to a wearer, the glove comprising an outer layer comprising a first and second surface; an inner layer comprising a third and fourth surface, the inner layer adapted to be oriented to the hand of the wearer, the inner layer being coupled in part to said outer layer; and a liquid composition disposed between the outer layer and the inner layer, the liquid composition comprising a halocarbon oil, an emulsifying agent, and a plurality of microcapsules. The glove may further comprise a valve coupled to the outer layer, whereby the liquid composition may be passed through the valve when the valve is in an open position. The outer layer and inner layer may be comprised of a water impermeable material. The halocarbon oil may further include additional ingredients, such as chlorotrifluoroethylene or polymers thereof In preferred embodiments of the invention, the halocarbon oil has a viscosity of from about 0.8 centistokes to about 56 centistokes when measured at 100°. Exemplary emulsifying agents include xanthan gum, ethyl cellulose, a clay, or mixtures thereof The clay may be a collodial clay. The microcapsules may be comprised of glass, may be hollow and may comprise a heat-absorbing material.

In still yet another aspect, the invention provides a method for making an insulating garment, the method comprising providing a first liquid impermeable layer, providing a second liquid impermeable layer, bonding the first layer and the second layer so as to form a reservoir, disposing a liquid composition in the reservoir, the liquid composition comprising a halocarbon oil, an emulsifying agent, and a plurality of microcapsules. The first liquid impermeable layer may be configured to conform substantially to a body portion over which it is placed. The method may further comprise coupling a valve to the first liquid impermeable layer or second liquid impermeable layer, whereby the liquid composition may be inserted or removed from the reservoir through the valve. The halocarbon oil may further include additional ingredients, such as chlorotrifluoroethylene or polymers thereof In preferred embodiments of the invention, the halocarbon oil has a viscosity of from about 0.8 centistokes to about 56 centistokes when measured at 100°. Exemplary emulsifying agents include xanthan gum, ethyl cellulose, a clay, or mixtures thereof. The clay may be a collodial clay. The microcapsules may be comprised of glass, may be hollow and may comprise a heat-absorbing material.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

DESCRIPTION OF ILLUSTRATIVE EMBODIMENTS

I. The Present Invention

Figure 1:
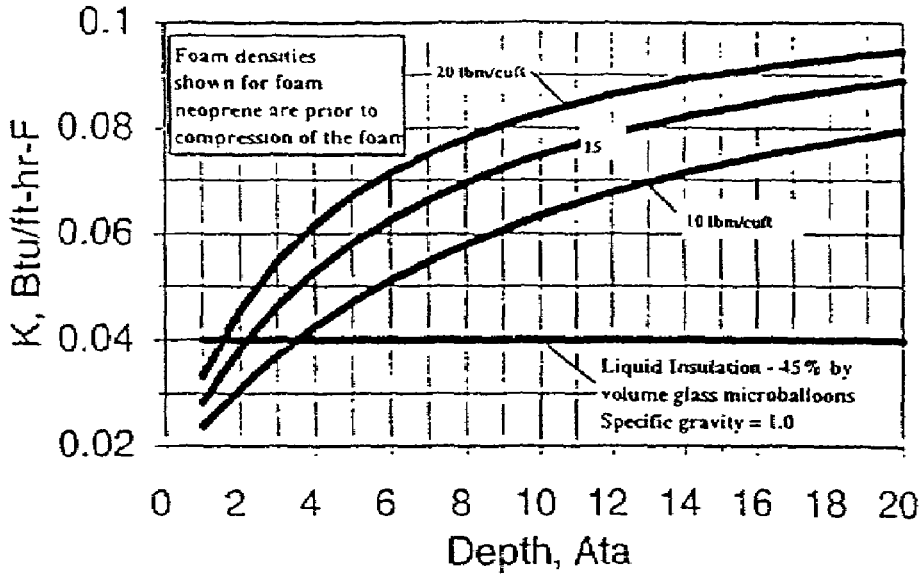
FIG. 1 shows a comparison of thermal conductivities for foam neoprene and liquid insulation at hyperbaric pressures. The foam densities cover the range prescribed by MIL-M-82400.

The present invention is directed generally to an insert, pourable, liquid composition that has insulation values approaching that of uncompressed foam neoprene and superior insulation compared to foam neoprene at elevated pressures, as shown in FIG. 1. Furthermore, the composition is unaffected by pressure, and may be formulated to be neutrally buoyant.

The composition is suitable for use an insulator, such as for divers' suits and accessories or underwater cabins (e.g., chambers, submersible hulls, waterproof housings, etc.). It is comprised of a halocarbon oil, an emulsifying agent, and a plurality of microcapsules. Because the composition may be formulated such that it is neutrally buoyant in water (has specific gravity of about 1.0), the necessity for ballasting is thereby eliminated. Furthermore, unlike conventional closed-cell foam or fibrous batt insulations, the composition of the present invention is not thermally degraded by compression in elevated hydrostatic pressures.

II. Components of the Insulating Composition

The composition of the present invention is comprised of three primary components: a halocarbon oil, a plurality of microcapsules, and an emulsifying agent. The characteristics of the composition may be tuned by changing the proportions of these components.

A. Liquids With Low Thermal Conductivity

An initial search was conducted to identify subtle insulating liquid mediums. This search focused on common cooking oils, available at any grocery store, having specific gravities of approximately 0.87 at 70° F. Additionally, white mineral oils having specific gravities ranging between 0.86 and 0.88 were investigated. All of these liquids met FDA regulations covering direct use in foods. A final family of liquids resulting from this survey were halocarbon oils, which are perhalogenated alkyl polymers having a low to medium molecular weight. In particular, a class of halocarbon oils comprising low and medium molecular weight polymers of chlorotrifluoroethylene (PCTFE, chemical formula $(CF_2CFCl)n$, with n varying from about 2 to about 10) was analyzed. These oils are manufactured by a controlled polymerization process and then stabilized to give them some very unique properties. They are safe, chemically inert and nonflammable and can be used in oxygen systems as lubricants. These oils were found to have low thermal conductivities, low viscosities and high specific gravities.

The apparent thermal conductivities of the candidate insulating liquids were measured experimentally using a Rapid-K Thermal Conductivity Instrument (manufactured by Holometrix, Inc. of Bedford, Mass.). Since the heat transfer through the test liquids in these investigations actually resulted from a combination of conduction and free convection, the term "apparent" thermal conductivity is used when discussing the measurements from this instrument.

Samples for testing were prepared by pouring approximately 16 ounces of the candidate liquids into 12"×12" zip-lock freezer bags. All air pockets were carefully removed from the bags prior to sealing which resulted in approximately a 0.25-inch thick liquid layer trapped in the bag for testing. The liquid-filled baggies were then positioned in the Rapid-K test chamber in contact with the hot and cold plates. The samples were allowed to remain in the test chamber until thermal stability was assured (thermal stability was assured by taking successive readings every 15 minutes until variations of less than 1% were observed).

Figure 7:
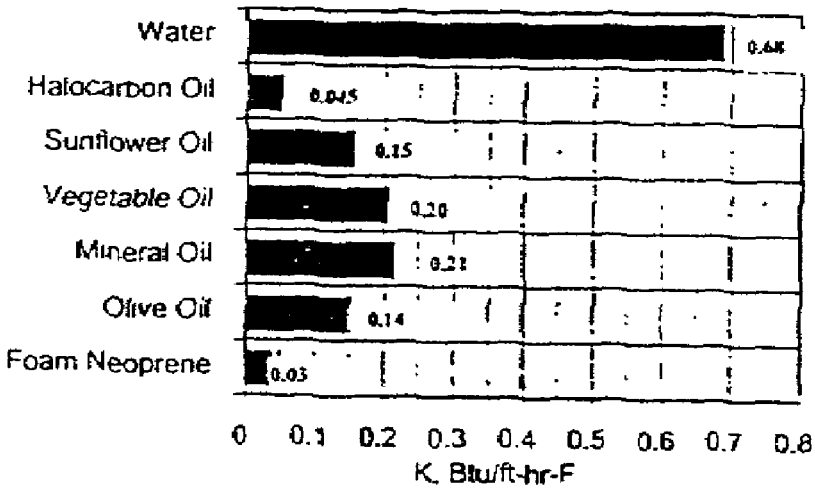
FIG. 7 shows a comparison of thermal conductivities for food quality insulating liquids considered in an initial screening process (0.25 inch liquid thickness).

FIG. 7 shows a comparison of the apparent thermal conductivities for a liquid thickness of approximately 0.25 inch for various liquids tested in this investigation, including vegetable oil, olive oil, mineral oil, sunflower oil, and halocarbon oil. Halocarbon oils with varying viscosities were used, including halocarbon 0.8, halocarbon 6.3 and halocarbon 27S, depending upon the desired results. Halocarbon 27S is a dense, low viscosity, colorless fluid that is used as a general purpose lubricant for bearings, compressors, gear boxes and pumps in oxygen-rich atmospheres. The thermal conductivity of foam neoprene is shown in FIG. 7 for comparison, since it is commonly used as an insulating material in divers' suits. Although none of the liquids tested had thermal conductivities as low as foam neoprene, all liquids tested had superior insulating qualities when compared to water. All of the liquids tested would be expected to significantly reduce the loss of heat from a diver when a thin layer is added to his glove or thermal garment. It will be understood to those of skill in the art that other such liquids exhibiting a low thermal conductivity can also be used with the invention. In preferred embodiments of the invention, the thermal conductivity of a liquid used with the invention is less than 0.04 Btu/ft-hr-° F.

The halocarbon oil was found to be particularly advantageous as it had an apparent thermal conductivity equivalent to some of the syntactic foams used for insulation in deep water environments. Furthermore, compositions comprising halocarbon oils are advantageous for use as insulators because halocarbon oils are generally inert, nonflammable, and nontoxic. Those skilled in the art will realize that a variety of halocarbon oils are suitable for use in the present invention. Halocarbon oils, such as halocarbon 0.8 and halocarbon 27S, that are low and medium molecular weight polymers of PCTFE are most preferred for use in the present invention. Other preferable halocarbon oils include halocarbon 0.8, halocarbon 1.8, halocarbon 4.2, halocarbon 6.3, halocarbon 27, and halocarbon 56 (the numerical designation after the term "halocarbon" refers to the liquid viscosity in centistokes at 100° F.) Furthermore, blends of different halocarbon oils may also be used. It is most preferable that the halocarbon or halocarbon blend that is chosen have a thermal conductivity of less than 0.04 Btu/ft-hr-° F. For foam neoprene, it is desired that the thermal conductivity is about equal to or is less than this number.

Figure 8:
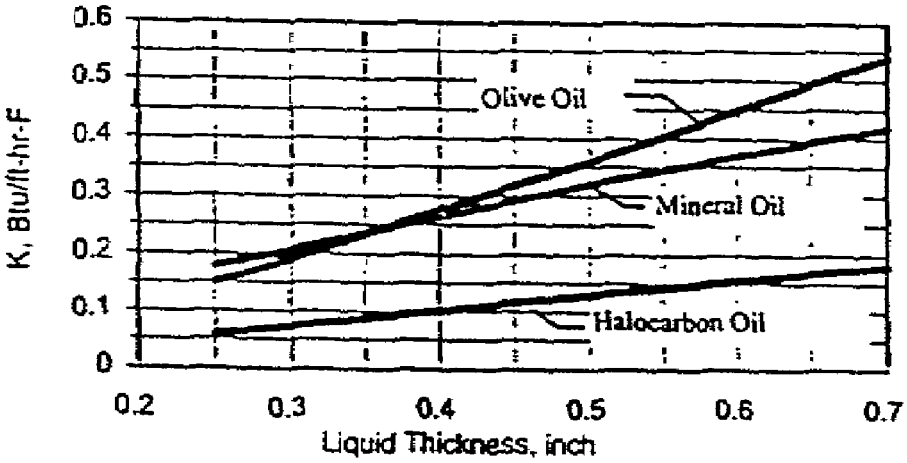
FIG. 8 shows apparent thermal conductivity of candidate liquids verses liquid layer thickness.

Due to the contributions of free convection currents anticipated in these tests it was initially expected that liquid layer thickness could have a significant impact on the apparent thermal conductivities measured in the Rapid-K. To verify this effect, liquid layer thickness between approximately 0.2 and 0.7 inches were tested using three candidate liquids. FIG. 8 shows the effect of liquid layer thickness on the observed thermal conductivity for these liquids. All three liquids were observed to increase in apparent thermal conductivity as the layer thickness increased. This data indicates that the addition of extra liquid to, for example, a liquid-filled protective glove or suit might not have a proportional increase in thermal insulation. That is, more liquid does not always contribute to better insulation values.

There are many advantages to using the halocarbon oil compositions of the present invention as insulators. For instance, the compositions are liquid which allows for easy underwater application (e.g. through either pouring or injecting) of the compositions into insulating garments or other apparatuses. Furthermore, because the compositions are liquid, it is possible to readily achieve a variable insulating effect by simply injecting or extracting the composition, such as from an insulating garment, as the situation may warrant. Likewise, this fluidity minimizes excessive bulk, maximizing mobility of the insulating medium when applied to, for example, a diver garment.

The compositions of the present invention are also advantageous because they may be formulated to possess neutral buoyancy. Unlike conventional foam or fibrous batt insulations requiring lead weights, or some other ballasting material to make the insulating medium neutrally buoyant, the present compositions may be formulated to be neutrally buoyant in water (specific gravity of about 1.0). Additionally, the specific gravity of the compositions may be easily changed to become neutrally buoyant when operating in other liquid environments by changing the microcapsule content, as discussed in more detail herein.

The halocarbon oil compositions are also relatively incompressible. The insulating effect obtained with the composition is unaffected by pressure due to the incompressible behavior of liquids. In contrast, conventional foam neoprenes and fibrous batt insulators are highly variable in insulating effect due to compression caused by the increased hydrostatic pressure as depth increases. The compositions are also particularly advantageous because the compositions are insoluble in water. In the event of accidental flooding with water of an insulating apparatus containing a composition of the present invention, the insulating effect of the composition will not be degraded, unlike foam or fibrous insulating batts.

B. Microcapsules

Results from the previously discussed laboratory testing demonstrate fairly low thermal conductivities, as compared to water. However, even further improvements are possible by mixing additives, such as microcapsules, with the halocarbon oil. Testing was conducted to determine the possibility of reducing thermal conductivities by adding particulate matter to the halocarbon.

Based on the results of the earlier screening tests Draekol™ (Penzoil Products Company, Kansas City, Pa.) white mineral oil and two grades of halocarbon oils (purchased from Halocarbon Products Corp., River Edge, N.J.), having different densities and viscosities, were selected for testing Two different microcapsules were investigated to potentially enhance the thermal properties of the candidate insulating liquids. Scotchlite™ (3M Corporation, St. Paul, Minn. Hollow Glass Microspheres were selected to both improve the thermal conductivities of the candidate liquids, as well as reduce the density of the heavy halocarbon oils to approximately that of water. Additionally, Thermasorb™ (Frisby Technologies, Clemmons, N.C.) micro-encapsulated phase change materials (PCM) were selected as potential additives to provide a source of stored thermal energy. Thermasorb 83 consists of octadecane, a paraffin wax having a melting temperature of 83° F., encapsulated in a microscopic hollow plastic spheres. A summary of liquid and additive properties for this phase of testing is given in Table 1.

TABLE 1

Properties of Insulating Liquids and Additives

| Liquid | S.G. | Viscosity, Cs | K, Btu/ft-hr-F |
|---|---|---|---|
| Draekol 34 | 0.87 | 72 | 0.0765 |
| Halocarbon 27S | 1.8 | 27 | 0.0442 |
| Halocarbon 0.8 | 1.6 | 0.8 | 0.0456 |
| **Additive** | | **S.G.** | **K, Btu/ft-hr-F** |
| K1 Scotchlite | | 0.06 | 0.022 |
| Thermasorb 83 | | 0.4 | 0.10 |

Figure 4:
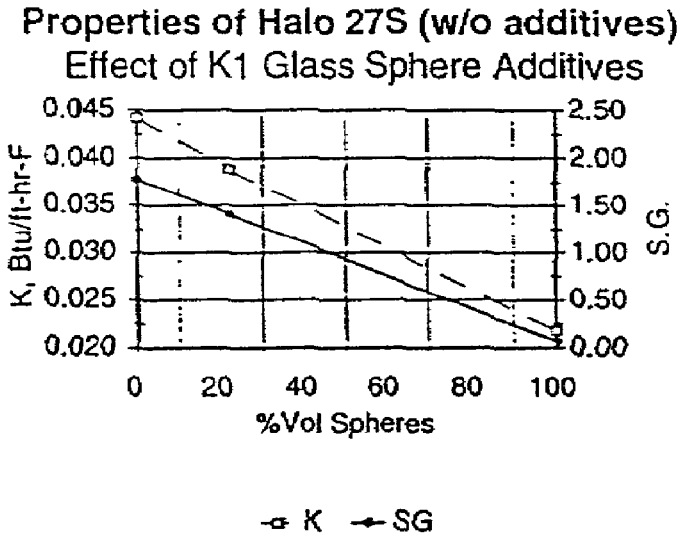
FIG. 4 shows thermal conductivity and specific gravity of halocarbon 27S and glass K1microspheres, without additives. The halocarbon and glass separated during the course of these tests.

The Scotchlite spheres, in solution with the insulating liquids, were found to have a dramatic effect on the measured thermal conductiveness (conductivity) and densities for the three candidate liquids. FIG. 4 shows the effect that adding various concentrations of glass spheres has on the thermal conductivity and density of halocarbon 27S. A near linear decrease in both of these liquid properties was seen as the volume percentage of glass spheres was increased. A desired specific gravity of 1.0 was obtained at a sphere volume concentration of approximately 45%. This loading of glass spheres resulted in an effective thermal conductivity of 0.033 Btu/ft-hr-° F. (approximately a 30% decrease). This thermal conductivity value is approximately the same as that recorded for uncompressed foam neoprene.

Similar thermal conductivity testing was conducted with liquid candidates when adding micro-encapsulated phase change materials. Unlike the steady decrease in thermal conductivities seen with the addition of hollow glass spheres, loadings of up to 35% PCMs showed minimal change in this thermal property. This was likely due to the fact that the wax material contained in the microscopic plastic spheres is as conductive as the liquid mediums. While this phase change additive may have some beneficial thermal effect for various applications, such as insulation in diver's gloves, provided that the wax is fully charged with latent heat (i.e., fully liquefied), prior to the start of the dive mission, the amount of stored energy is probably not a sufficient tradeoff to offset these higher thermal conductivity values.

A wide range of thermal conductivities and specific gravities can be achieved using the composition of the present invention by varying the content of the microcapsules. The microcapsules are preferably less dense than the halocarbon oil. Thus, adding additional microcapsules serves to reduce the density of the composition. As used herein, the term "microcapsules" is meant to refer to a class of micro filler materials, such as 3M Scotchlite™ Hollow Glass Microspheres, that are of low density and which possess low thermal conductivity. The 3M™ microspheres are engineered particles designed to be an alternative to conventional fillers and additives to provide higher filler loadings, lower viscocities, improved flow, and better cost effectiveness. The K1spheres used as an additive were made of soda-lime-borosilicate glass with a particle size range of 30-120 microns. The capsules may be of any shape, and may be hollow or may contain a filler material to help reduce the thermal conductivity of the microcapsule. Furthermore, the microcapsules may be made for a variety of suitable materials, including various polymers and glass and the like. Those skilled in the art will realize that a variety of microcapsules may be used in connection with the present invention.

Figure 5:
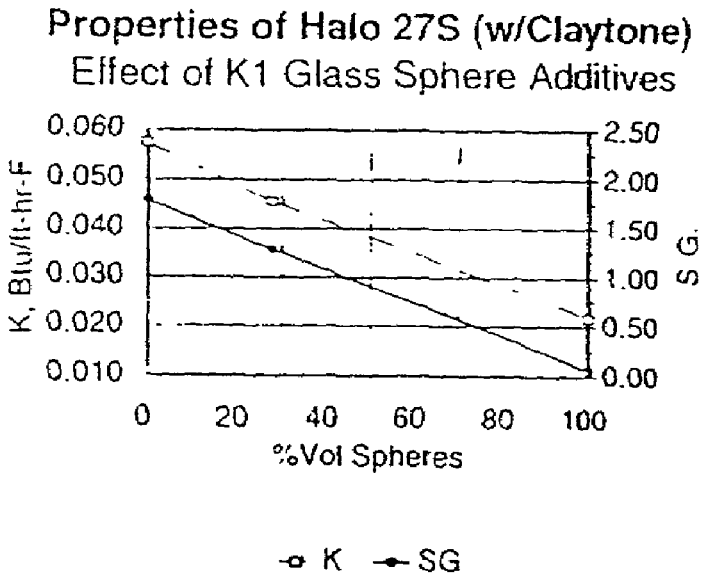
FIG. 5 shows the thermal conductivity and specific gravity of halocarbon 27S and glass sphere mixtures with 6% by weight of collodial clay additive.

For applications in which thermal conductivity must be minimized, or when being used in a low density fluid medium, the microcapsule content can be maximized as seen in FIG. 5 and still be neutrally buoyant. Conversely, higher specific gravities can be achieved with this insulating medium by minimizing the microcapsule content at the expense of increasing thermal conductivity. Thus, one may achieve the desired characteristic (i.e. low thermal conductivity or increased specific gravity) by varying the microcapsule content.

C. Emulsifying Agents

Due to the wide variety in densities for the halocarbon oil and microcapsules that may be used, see table 2, it is preferable to use an emulsifying agents to keep the microcapsules from separating during prolonged periods after the microcapsules are mixed with the halocarbon oil.

TABLE 2

Properties of Insulating Liquid and Glass Additive

| Liquid | S.G. | Viscosity, Cs | K, Btu/ft-hr-F |
|---|---|---|---|
| Halocarbon 27S | 1.8 | 27 | 0.0442 |
| **Additive** | **S.G.** | | **K, Btu/ft-hr-F** |
| K1 Scotchlite | 0.06 | | 0.022 |

Emulsifying agents are often used in food preparation applications where two different liquids, or liquids and powders, are mixed (e.g., salad dressings, sauces, pharmaceuticals, etc.). Various emulsifying agents were tested to determine the ability of the agent to maintain particle suspension in liquids.

ISOXAN (Ingredient Solutions, Inc., Searsport, Me.) is a food grade xanthan gum derived from Xanthomonas campestris by a pure culture fermentation process. It is a cream-colored powder and can be used as a thickening agent in hot or cold applications. The Claytone (Southern Clay Products, Gonzales, Tex.) products, Claytone AF, HY, and APA, are very light, finely ground powders which are classified as rheological additives. These additives are used to prevent settling and agglomeration of pigments and fillers mixed in oil based systems. Additionally, EC-N100 0100 and EC-N22 0100 (Hercules Inc., Wilmington, Del.) were tested. These two products are high viscosity ethyl cellulose and low viscosity ethyl cellulose products, respectively.

A series of test trials were conducted to determine if any of the above liquid additives could keep the glass micro-spheres in liquid suspension and find the best combination of liquid/additive to minimize the mixture thermal conductivity. Table 3 summarizes these test trials.

TABLE 3

Liquid Mixing Trials

| Test # | Liquid Mixture | Additive | Consistency | Results |
|---|---|---|---|---|
| 1 | 20 ml GM; added 11 H to fill 125 ml beaker | None | Creamy mixture | Separated within 10 minutes |
| 2 | 20 ml GM; added 11 H to fill 125 ml beaker | 1 tsp ISOXAN 200 | Creamy mixture | Separated within 10 minutes |
| 3 | 20 ml GM; added 11 H to fill 125 ml beaker | 1 tsp Hercules ECN100 | Creamy mixture | Separated within 10 minutes |
| 4 and 5 | Same as tests #2 and #3 with more additive | Added 2 tsp of each additive | Creamy mixture | Separated again |
| 6 and 7 | Same as tests #4 and #5 with more additive | Added 3 tsp of each additive | Creamy mixture | Separated again |
| 8 | 20 ml GM; added water to fill 125 ml beaker | 1 tsp ISOXAN 200 | Thick, pasty mix | Stayed in suspension |
| 9 and 10 | 20 ml GM; added 11 H to fill 125 ml beaker and added additional 20 ml water | 3 tsp each additive | Creamy mixture | Remained in suspension |
| 11 | 45 ml GM; added water to fill 125 ml beaker | None | White, milky mixture | Separated within 10 minutes |
| 12 | 45 ml GM; added water to fill 125 ml beaker | 1 tsp ECN100 | White, milky mixture | Separated within 10 minutes |
| 13 | 45 ml GM; added water to fill 125 ml beaker | 1 tsp ISOXAN 200 | Thick, pasty mix | Stayed in suspension over 4 days |
| 14 | 50 ml water and 50 ml H | None | Thin, translucent liquid | Separated within minutes |
| 15 | 50 ml water and 50 ml H | ½ tsp ISOXAN | Creamy mixture | Stayed in suspension |
| 16 | 50 ml water and 50 ml H; added 50 ml GM | ½ tsp ISOXAN | Whipped cream | Stayed in suspension |
| 17 | 50 ml water and 50 ml H; added 50 ml GM | 1 tsp ECN100 | White, milky mixture | Separated within 2 minutes |
| 18 | 25 ml water and 75 ml H | ⅓ tsp ISOXAN | White, milky mixture | Foamy material formed at top |
| 19 | 25 ml water and 75 ml H | ⅔ tsp ISOXAN | White, milky mixture | Foamy material formed at top |
| 20 | 25 ml water and 75 ml H; added 25 ml GM | ⅔ tsp ISOXAN | White, Creamy mixture | Separated; looks like sour milk with curds risen to top |
| 21 | 20 gm GM in water (500 ml total) | None | Thin, milky mixture | Separated in minutes |
| 22 | 20 gm GM in water (500 ml total) | ½ tsp ISOXAN | Thin, creamy mixture | Stayed in suspension |
| 23 | 200 ml water and 200 ml H | None | Thin, watery mixture | Separated immediately |
| 24 | 200 ml water and 200 ml H | ½ tsp ISOXAN | Creamy emulsion | No separation observed |
| 25 | 20 gm GM added 324 mix (500 ml total) | ½ tsp ISOXAN | Thick, whipped cream mixture | No separation observed during following day |
| 26 | 500 ml H | 49.6 gm Claytone APA (6 wt %) | Light green, creamy mix | No separation observed after two days |
| 27 | 20 gm GM and 500 ml H | 49.6 gm Claytone APA (6 wt %) | Thick, creamy mix | No separation observed after two days |

GM—glass micro-spheres
H—halocarbon
tsp—teaspoon

The tests revealed several findings. First, the glass microspheres separate quickly from either water or halocarbon oil without the use of additives. Second, the ethylcellulose additives showed minimal effect in maintaining glass suspension in either water or halocarbon oil. Third, the xanthan gum (ISOXAN) additive showed minimal effect in maintaining glass suspension in halocarbon oil alone. Fourth, the xanthan gum additive was very effective in maintaining glass suspension in water. This mixture resulted in a thick, creamy emulsion (similar in consistency to sinus mucous) with approximately 42.5 vol % glass microspheres. Fifth, the xanthan gum additive was very effective in maintaining a glass suspension in 50/50 mixtures of water and halocarbon oil. This mixture resulted in a similar thick emulsion as seen with water alone with approximately 36 vol % glass microspheres. One teaspoon of xanthan gum was found to be effective in maintaining glass suspension in 400 ml of water, or in solutions of 50% water, 50% halocarbon solutions. Sixth, the effectiveness of xanthan gum additive was seen to lessen as the percentages of halocarbon oil was increased above 50% in water/halocarbon oil mixtures. Seventh, 6 wt % colloidal clay (Claytone APA) mixed in halocarbon oil was very effective in maintaining glass suspension. This mixture resulted in a thick, creamy mixture with approximately 28 vol % glass microspheres. Finally, colloidal clay at about 6% to 8% by weight was found to be the best additive to maintain glass microsphere suspension in halocarbon oil of the three additives tested.

As demonstrated in the above mixing experiments, the most effective means of maintaining glass microspheres in liquid suspension was achieved by either adding xanthan gum to water or water/halocarbon oil mixtures, or by adding colloidal clay to the halocarbon oil. Additional laboratory testing was conducted using a Rapid-K Thermal Conductivity Instrument to determine what impact, if any, these additives had on the insulation potential of candidate insulating liquids. The thermal conductivities of halocarbon/glass, water/glass, and a 50% water/halocarbon/glass mixture were measured.

Figure 2:
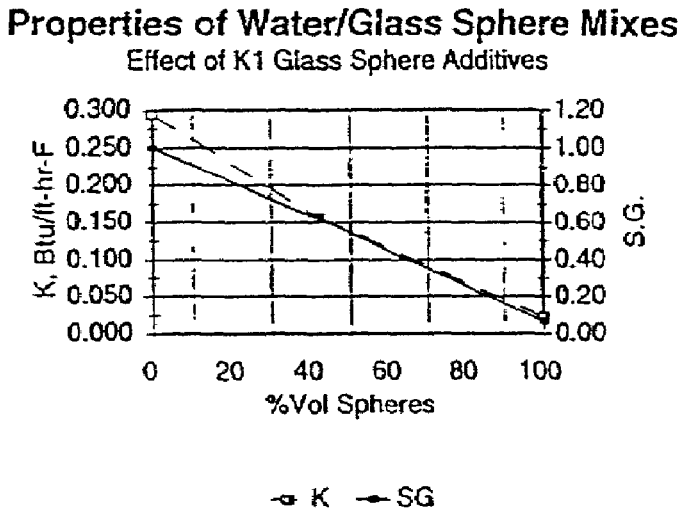
FIG. 2 shows the thermal conductivity and specific gravity of water and glass sphere mixtures with ISOXAN 200 additive.
Figure 3:
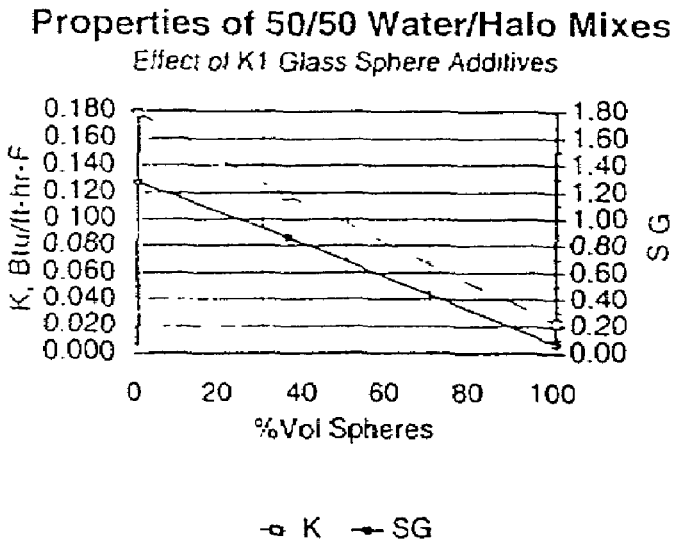
FIG. 3 shows the thermal conductivity and specific gravity of 50% water/50% halocarbon 27S mixtures and glass spheres with ISOXAN 200 additive.
Figure 6:
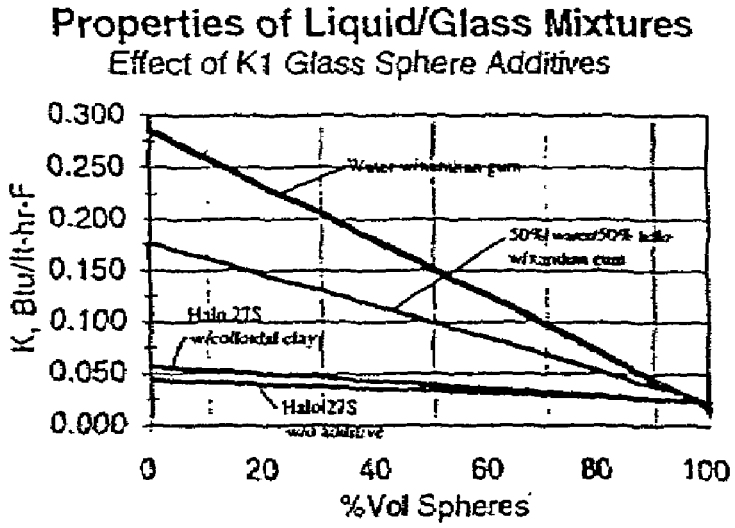
FIG. 6 shows a comparison of thermal conductivities of different liquid/glass sphere mixtures.

Xanthan gum was effective in maintaining glass suspension in water and 50% water/50% halocarbon solutions only. FIG. 2 shows the thermal conductivities and specific gravities for various percentages of glass microspheres in water after adding ISOXAN 200 (xanthan gum). FIG. 3 shows similar results for a 50% water/50% halocarbon oil mixture with the same xanthan gum additive. FIG. 4 shows the thermal conductivities and specific gravities for various percentages of glass microspheres in halocarbon oil 27S without any additive (the halocarbon and glass separated during testing). FIG. 5 shows the thermal conductivities and specific gravities for various percentages of glass microspheres in halocarbon oil 27S with the colloidal clay additive. FIG. 6 shows all four liquid combinations on a single graph for comparison. Using a desired specific gravity of 1.0 for comparison, table 4 shows the preferred percentages of microcapsules and the resulting thermal conductivities for each liquid mixture.

TABLE 4

Comparison of Liquid Thermal Conductivities at Specific Gravity of 1.0

| Liquid Mixture | Glass Microspheres % volume | Thermal Conductivity Btu/ft-hr/° F. |
|---|---|---|
| 100% Water (w/xanthan gum additive) | 0 | 0.294 |

TABLE 4-continued

Comparison of Liquid Thermal Conductivities at Specific Gravity of 1.0

| Liquid Mixture | Glass Microspheres % volume | Thermal Conductivity Btu/ft-hr/° F. |
|---|---|---|
| 50% water/50% halocarbon (w/xanthan gum additive) | 25 | 0.14 |
| 100% Halocarbon oil (w/o additive) | 45 | 0.034 |
| 100% Halocarbon oil (3/6 wt % colloidal clay additive) | 45 | 0.04 |

These tests verify that the lowest thermal conductivities can be achieved by adding higher concentrations of microcapsules, and by using the highest percentage of halocarbon oil in the liquid mixtures. These high concentrations of halocarbon oil and microcapsules were found to be most readily achievable with the colloidal clay additive. Although this clay additive did increase the apparent thermal conductivity of the halocarbon/glass mixture slightly, as compared to the same mixture without any additive, it was successful in maintaining a homogeneous glass/liquid mixture without showing any signs of glass separation after several days' observation. The emulsifying agents discussed herein are merely examples of acceptable agents that may be used. Those skilled in the art will realize that emulsifying agents other than those listed herein may also be used in the present invention.

III. Use of the Compositions in Insulating Apparatuses

A variety of insulating garments and apparatuses that utilize various liquids for insulators are known, such as those described in U.S. Pat. No. 5,960,469 to Nuckols et al. and U.S. Pat. No. 3,744,053 to Parker et al. The compositions of the present invention may be used in these and other conventional devices that rely on liquid insulators. A typical insulating garment may comprise a first liquid impermeable layer and a second liquid impermeable layer. The two layers are typically bonded together in some fashion. For instance, the two layers may be bonded at the edge of the layers, such that the two bonded layers form a single bladder or reservoir. Alternatively, the layers may be bonded in a fashion such that a plurality of sealed bladders are formed.

Furthermore, the garment may also comprise a valve that may be used to insert or remove liquid from the bladder. A pump may also be connected to the insulating garment through use of a hose or other suitable means. The pump may be used to circulate liquid through the garment. The pump may also be attached to or integral with a heating unit that may be used to warm the liquid that is circulated through the insulating garment. Those skilled in the art will realize that the garment may be constructed of any fabric or material that is conventionally used in diving applications. For instance, the garment may be made from a material possessing elastic properties, thereby allowing the garment to form-fit to the body on which it is placed. Preferably the material is also water impermeable so that water does not leak into the bladder.

Figure 10:
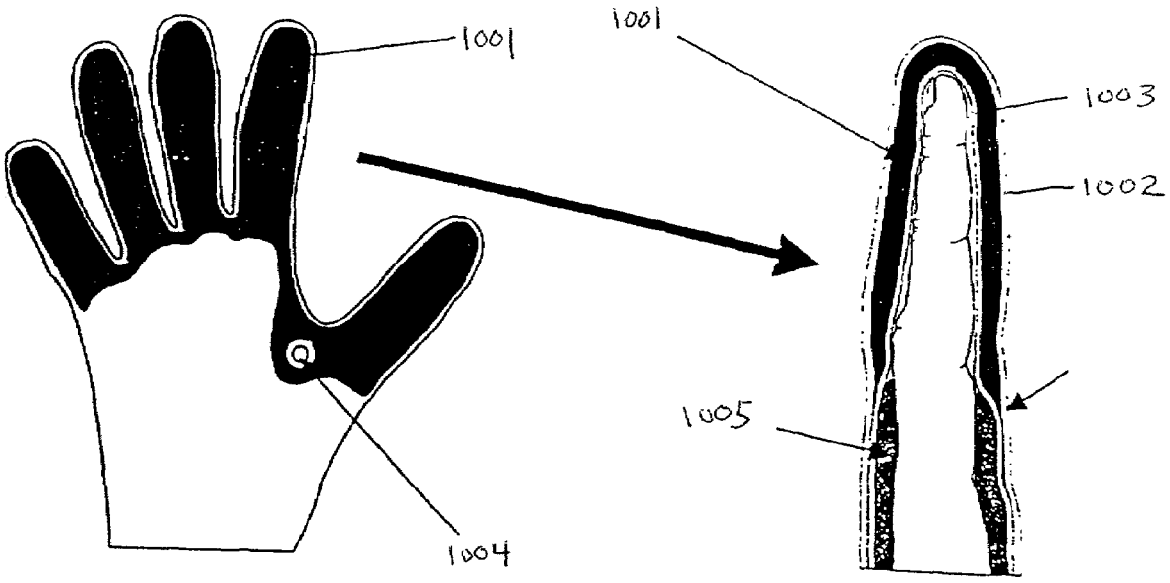
FIG. 10 shows one embodiment of a glove filled with a composition according to the present invention.

The use of the liquid insulating compositions of the present invention may be particularly advantageous in a variety of applications. One such application is diver's gloves, and one embodiment of a diver's glove is shown in FIG. 10. As shown in FIG. 10, the glove comprises a reservoir or bladder 1001 filled with a liquid composition according to the present invention. The liquid-filled bladder 1001 surrounds the fingers and thumb. The bladder consists of a double-walled five-finger glove sealed together at the knuckles. The inner lining 1003 is form-fitting on the hand, with an inner nylon fabric slip surface to make the glove easy to doff and don. The outer liner 1002 is sufficiently larger than the inner liner to provide approximately 0.25-inch liquid thickness when inflated through the liquid-filled port or valve 1004. Both liner walls may have roughened surfaces on the side in contact with the liquid, to minimize slip when grasping an object. Furthermore, the glove may contain conventional solid insulation 1005 in the palm and dorsal regions of the hand.

One of the primary advantages of using liquid insulation in divers' gloves is the expected enhancement in dexterity and tactile sensitivity. Unlike with fibrous or foam insulating materials, when the diver grasps an object while wearing liquid-insulation gloves, the liquid will move away from the region in which the fingers are contacting the object, resulting in a momentary reduction in insulation but improved dexterity. After releasing the object, the liquid will re-surround the diver's fingers, returning the insulating quality of the glove. Since the insulating liquid has been engineered to have a density approximately that of the surrounding seawater, this insulation comes without the additional cost of added buoyant forces on the diver glove, and also helps to minimize suit squeeze around the extremities. Additionally, various insulation values can be readily achieved by controlling the quantity of liquid injected into the glove liner.

The insulation levels that may be achieved with the liquid-filled glove liners are comparable to uncompressed foam neoprene. Due to their incompressible behavior, these liquids will maintain their inherent insulation values at elevated pressures, unlike foam neoprene, and they can be engineered to be neutrally buoyant.

Theoretical glove insulation values for one embodiment of the gloves of the present invention were also determined. For these tests, a gloved hand was modeled as a 7-zone appendage, each zone with its own localized level of insulation. The total glove insulation (Clo-one Clo is the insulation of a standard business suit in air, 1 Clo=1.136/$U_o$) was calculated using the relationship:

$$\text{Total } Clo = \frac{\sum (SA)_i}{\sum \left(\frac{SA}{Clo}\right)_2} \tag{1}$$

where $(SA)_i$ is the surface area of each of the seven zones and $(SA/Clo)_1$, is the ratio of the localized surface area to insulation value for each zone. Table 5 identifies the localized surface areas used in this analysis (based on the measured surface areas of the 75 percentile cast aluminum hard calorimeter used at the Navy Clothing and Textile Research Facility at Natick, Mass.)

TABLE 5

Localized Hand Dimensions

| Zone | Region | Length (in.) | Rea. Sqm | Area, sqft | % Area |
|---|---|---|---|---|---|
| 1 | Thumb | 2.5 | 0.0049 | 0.0527432 | 9.70 |
| 2 | Index | 2.75 | 0.004521 | 0.0486636 | 8.95 |
| 3 | Middle | 3.25 | 0.005353 | 0.0576192 | 10.59 |
| 4 | Ring | 3 | 0.00484 | 0.0520973 | 9.58 |
| 5 | Little | 2.375 | 0.003341 | 0.0359622 | 6.61 |
| 6 | Palm | 4 × 4.5 | 0.012346 | 0.1328912 | 24.43 |
| 7 | Dorsal | 4 × 4.5 | 0.01523 | 0.1639344 | 30.14 |
| | Total | | 0.050531 | 0.5439112 | 100.00 |

The localized heat transfer from each zone of the hand to the surrounding water can be calculated as:

$$\dot{Q}_i = U_{oi}(SA_o)_i(T_s - T_\infty) \tag{2}$$

where $\dot{Q}$ is the localized heat flux from each of the hand zones, $U_{o_i}$ is the localized heat transfer coefficient based on the outside surface area, $(SA_o)_i$ is the localized outside surface area of the glove zone, $T_s$ is the mean skin temperature on the hand, and $T_\infty$ is the ambient water temperature.

Figure 11:
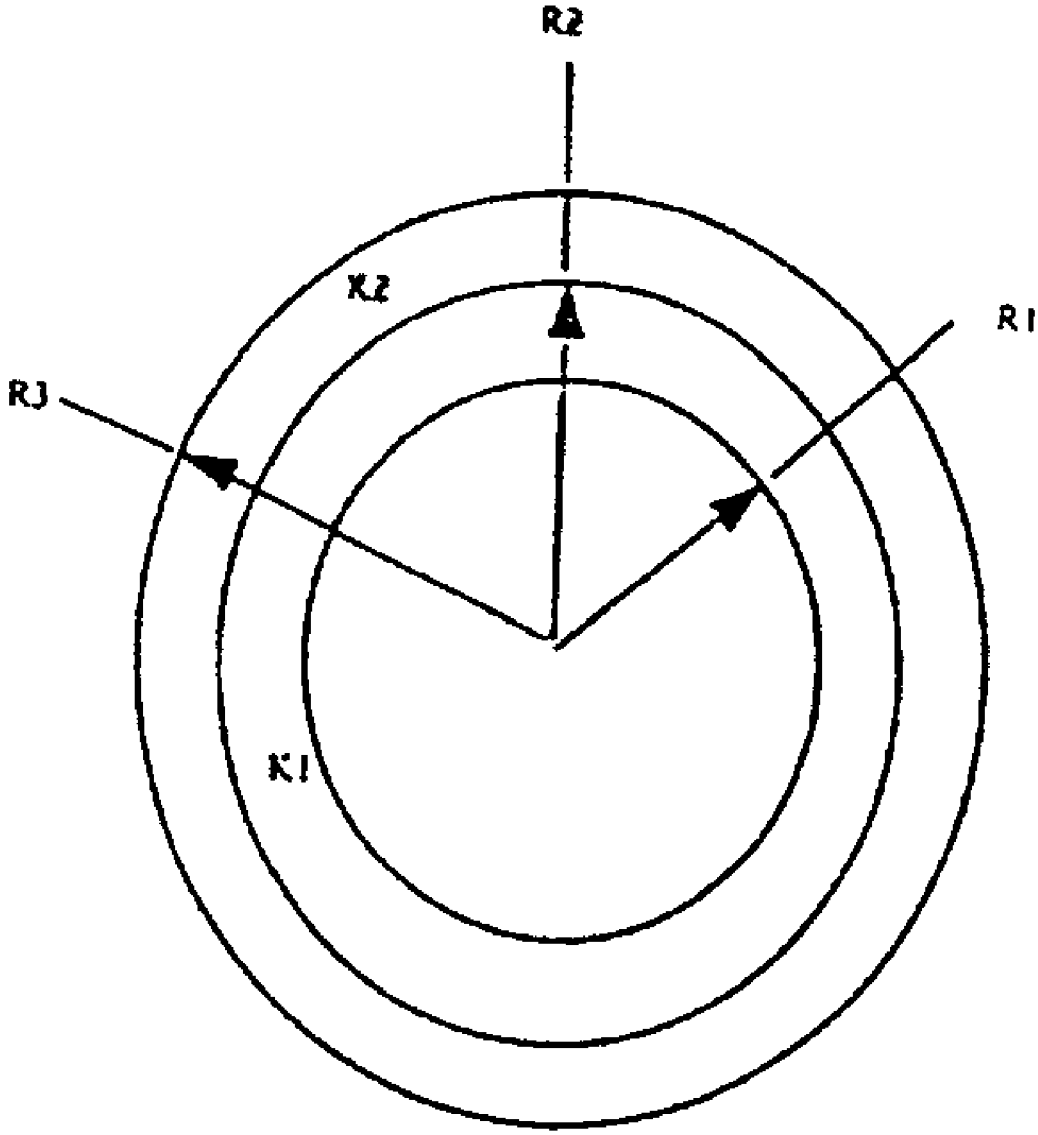
FIG. 11 is a digit cross-section showing insulation and glove shell surrounding a finger.

The localized heat transfer coefficients were calculated assuming that the thermal resistance in each zone could be modeled as if concentric cylinders consisting of the glove insulation and the glove shell are surrounding each zone, as shown in FIG. 11.

The overall heat transfer coefficient of a single zone can then be calculated in cylindrical coordinates as:

$$U_{o_i} = \frac{1}{\frac{R3_i}{K2}\ln\left(\frac{R3_i}{R2_i}\right) + \frac{R3_i}{K1}\ln\left(\frac{R2_i}{R1_i}\right) + \frac{1}{h_{o_i}}} \tag{3}$$

where $R1_i$ is the mean radius of the individual zone, $R2_i$ is the radius of the insulation, $R3_i$ is the outside radius of the glove shell, K1 is the thermal conductivity of the glove insulation, K2 is the thermal conductivity of the glove shell, and $h_{oi}$ is the convective heat transfer coefficient on the outside of the glove shell. The mean radius of each cylindrical digit zone was calculated from the known surface areas and lengths given in table 5 as $$R1_i,\ \text{ft} = \frac{SA_i(\text{ft}^2)}{2\pi\frac{L_i(\text{in})}{12\frac{\text{in}}{\text{ft}}}} \tag{4}$$

The mean radius of the palm and dorsal areas of the hand were calculated assuming that they are half cylinders. Thus, for one palm and dorsal zones $$R1_{Palm,Dorsal},\ \text{ft} = \frac{SA_i(\text{ft}^2)}{\pi\frac{L_i(\text{in})}{12\frac{\text{in}}{\text{ft}}}} \tag{5}$$

Figure 9:
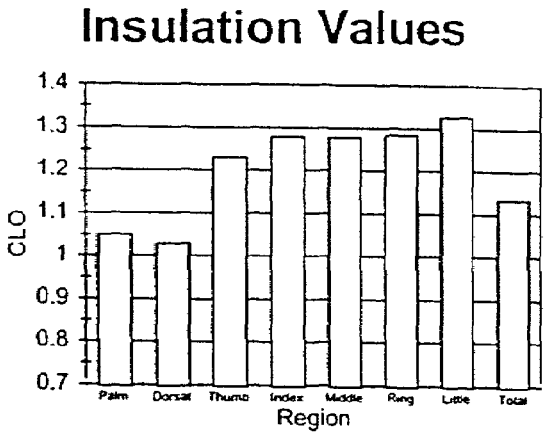
FIG. 9 shows localized and total insulation values predicted for a glove liner containing a 0.3 inch thick liquid layer beneath a glove shell that is 0.05 inches thick. The liquid has a thermal conductivity of 0.032 Btu/ft-hr-° F. and the glove shell as a thermal conductivity of 0.12 Btu/ft-hr-° F.

FIG. 9 shows the predicated localized and total insulation value (1.13 Clo) for a glove liner containing a 0.3-inch thick liquid layer beneath a glove shell that is 0.05 inches thick. The liquid was assumed to have a thermal conductivity of 0.032 Btu/ft-hr-° F. The convective heat transfer coefficient between the glove shell and the surrounding water was assumed to be 400 Btu/ft-hr-° F.

REFERENCES

1. Adolfson, J. (1987), "Functional Investigation of Protective Gloves for Divers and Workers in Adjacent Fields of Activity," Foersvarets Forskningsanstalt Report No. FOA-A-50004-5.2, Stockholm, Sweden
2. Olsen, R. G. (1990), "RF Energy for Warming Divers' Hands and Feet," *Emerging Electromagnetic Medicine,* 1990, pp 135-143.
3. Weinberg, R. P., Thalmann, E. D. (1989), "Effects of Hand and Foot Heating on Diver Thermal Balance," Naval Medical Research Institute Report No. NMRI-90-52, Bethesda, Md. 4. Nuckols, M. L., Ramey, R. A., Courson, B. F., Zoulias, J. G. (5 Oct. 99), "Liquid-Insulated Garment for Cold Water Diving," Patent #5,960,469.

What is claimed is:

1. A composition comprising:

a liquid with a thermal conductivity of less than about 0.04 Btu/ft-hr-° F.;

an emulsifying agent; and a plurality of microcapsules.

2. The composition of claim 1, wherein the liquid is a halocarbon oil.

3. The composition of claim 2, wherein the halocarbon oil comprises chlorotrifluoroethylene or polymers thereof.

4. The composition of claim 2, wherein the halocarbon oil has a viscosity of from about 0.8 centistokes to about 56 centistokes when measured at 100° F.

5. The composition of claim 1, wherein the halocarbon oil is Halocarbon 0.8, Halocarbon 6.3 or Halocarbon 27S, or mixtures thereof.

6. The composition of claim 4, wherein the microcapsules comprise about 5% to about 60% by volume of the composition.

7. The composition of claim 6, wherein the microcapsules comprise about 40% to 50% by volume of the composition.

8. The composition of claim 1 wherein the composition has a thermal conductivity of less than about 0.06 Btu/ft-hour-° F.

9. The composition of claim 1 wherein the composition has a thermal conductivity of less than about 0.04 Btu/ft-hour-° F.

10. The composition of claim 8 wherein the composition has a thermal conductivity of between about 0.02 and about 0.06 Btu/ft-hour-° F.

11. The composition of claim 1, wherein the emulsifying agent comprises about 3% to about 8% by weight of the composition.

12. The composition of claim 11, wherein the emulsifying agent comprises about 5% to about 8% by weight of the composition.

13. The composition of claim 1, wherein the emulsifying agent comprises xanthan gum.

14. The composition of claim 1, wherein the emulsifying agent comprises ethyl cellulose.

15. The composition of claim 1, wherein the emulsifying agent comprises a clay.

16. The composition of claim 6, wherein the clay comprises collodial clay.

17. The composition of claim 1, wherein the microcapsules are glass.

18. The composition of claim 17, wherein the microcapsules are hollow.

19. The composition of claim 1, wherein the microcapsules comprise a heat-absorbing material.

20. The composition of claim 1, further comprising water.

21. The composition of claim 20, wherein the composition comprises about equal parts of the water and the oil, wherein the emulsifying agent comprises a xanthan gum, and wherein the microcapsules comprise about 36% by volume of the composition.

22. The composition of claim 1, wherein the emulsifying agent comprises about 6%-8% by weight of a collodial clay, and wherein the microcapsules comprise about 28% by volume of the composition.

23. The composition of claim 1, wherein the composition has a specific gravity of about 1.0.

24. A method for preparing a composition suitable for use as an insulator, the method comprising mixing a liquid with a thermal conductivity of less than about 0.04 Btu/ft-hr-° F., a plurality of microcapsules, and an emulsifying agent, wherein the emulsifying agent is present in sufficient amount to suspend the microcapsules in the composition.

25. The method of claim 24, wherein the liquid comprises a halocarbon oil.

26. The method of claim 25, wherein the halocarbon oil comprises chlorotrifluoroethylene or polymers thereof.

27. The method of claim 25, wherein the halocarbon oil has a viscosity of from about 0.8 centistokes to about 56 centistoke when measured at 100° F.

28. The method of claim 27, wherein the halocarbon oil is Halocarbon 0.8, Halocarbon 6.3, Halocarbon 27S or mixtures thereof.

29. The method of claim 24, wherein the emulsifying agent comprises xanthan gum, ethyl cellulose, a clay, or mixtures thereof.

30. The method of claim 24, wherein the emulsifying agent comprises a collodial clay.

* * * * *